United States Patent [19]

Collins

[11] 4,096,979

[45] Jun. 27, 1978

[54] BELT BUCKLE KNIFE

[75] Inventor: Walter W. Collins, Rock Hill, S.C.

[73] Assignee: Robert W. Brewer, Jr., Rock Hill, S.C.

[21] Appl. No.: 743,595

[22] Filed: Nov. 22, 1976

[51] Int. Cl.[2] ..... A45C 11/00

[52] U.S. Cl. ..... 224/26 B; 24/163 K; 30/162; 206/38; 206/234; 224/5 A

[58] Field of Search ..... 224/1 R, 2 D, 5 R, 5 A, 224/5 B, 26 R, 26 B, 26 D, 26 E, 28 B, 26 F, 26 H, 26 J, 28 D, 28 E; 30/151, 154, 155, 158, 159, 160, 161, 162; 24/163 K, 3 F; 206/37, 38, 234; 46/1 E; 42/1 J, 1 K, 54; 7/1 B, 1 C, 14.1 R

[56] References Cited

U.S. PATENT DOCUMENTS

| | | | |
|---|---|---|---|
| 1,508,963 | 9/1924 | Dorf | 224/26 E X |
| 1,614,949 | 1/1927 | Finley | 30/161 X |
| 1,969,100 | 8/1934 | Segal | 30/155 X |
| 2,162,654 | 6/1939 | Vaisey | 30/155 |
| 2,618,057 | 11/1952 | Gibson | 224/2 D |
| 3,026,642 | 3/1972 | Ryan | 46/1 E |
| 3,559,854 | 2/1971 | Loveland | 224/28 B |
| 3,783,509 | 1/1974 | Lake | 30/161 |
| 3,823,421 | 7/1974 | Collins | 224/5 R X |
| 3,924,304 | 12/1975 | Grandmont | 224/26 E X |

OTHER PUBLICATIONS

American Rifleman, "In My Arms Collection", Feb., 1954, pp. 26 & 27.

*Primary Examiner*—Trygve M. Blix
*Assistant Examiner*—Winston H. Douglas
*Attorney, Agent, or Firm*—Luke J. Wilburn, Jr.; Wellington M. Manning, Jr.

[57] ABSTRACT

A combination belt buckle and knife for use with a belt as an attractive article of wear, and wherein a knife blade concealed within a recess of the belt buckle is removably detached from a base member of the buckle, with the cover plate for the base member recess serving as a handle for the knife blade in use.

12 Claims, 6 Drawing Figures

BELT BUCKLE KNIFE

The present invention is directed to a combination belt buckle and knife, and, more particularly, to a belt buckle and knife device wherein the knife blade is effectively contained and concealed within the buckle during wear, and may be quickly and easily removed therefrom for use, with a portion of the buckle serving as the handle for the knife blade.

It is an object of the present invention to provide a combination belt buckle and knife device which provides an aesthetically attractive belt buckle for wear, with concealed storage of a knife therein which may be quickly removed from the buckle for use.

The invention will be better understood from the following detailed description of preferred embodiments thereof, when taken together with the accompanying drawings, in which.

Figure 2:
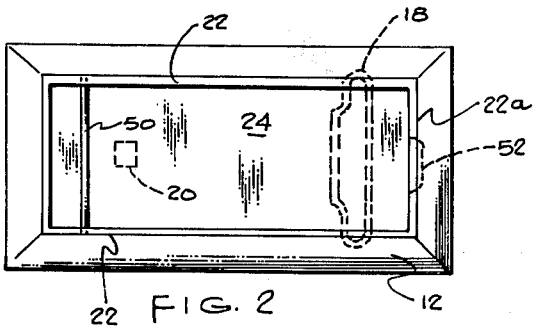
FIG. 2 is a front view, on reduced scale, of the base member of the belt buckle knife of FIG. 1, with the front cover plate of the base member removed therefrom.
Figure 5:
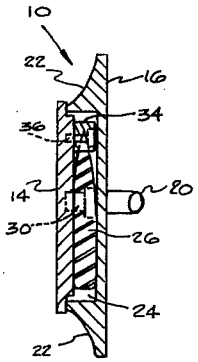
FIG. 5 is a sectional view of the belt buckle knife taken along line V—V of FIG. 1.

Referring more specifically to the drawings, the belt buckle knife 10 of the present invention comprises a base member 12 having a removable front cover plate 14. As best seen in FIGS. 2 and 5, the base member has a flat rear face 16 to which is attached a ring 18 and finger-like hook 20 for receiving opposite ends of a conventional belt (not shown). The base member has an upstanding peripheral edge portion 22 which defines peripheral walls of a recess or compartment 24 within the base member for the concealed containment of a knife blade 26 and blade-locking mechanism 28 attached to the inside face of the cover plate 14 (FIG. 3).

Figure 3:
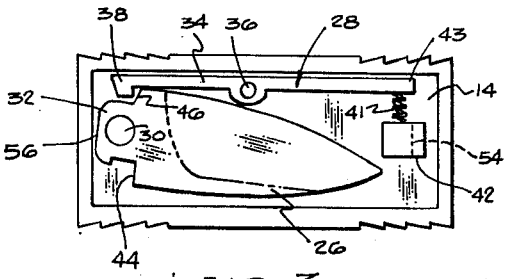
FIG. 3 is a view of the inside face of the removed cover plate of the base member seen in FIG. 2, and showing the component parts of the knife with the blade positioned in closed condition for concealment within the buckle.
Figure 4:
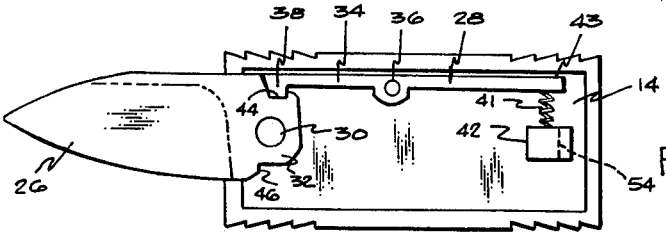
FIG. 4 is a view of the inside face of the cover plate of FIG. 3 illustrating the knife blade in locked extended position for use.

As seen in FIGS. 3 and 4, knife blade 26 is attached to the inside face of the cover plate for pivotal movement between a first or closed position (FIG. 3) wherein the blade overlies the inside face of the cover plate 14 and a second or open position (FIG. 4) wherein the blade extends outwardly from the cover plate for use, with the cover plate serving as a handle for the blade. The blade is mounted for pivotal movement between said first and second positions through a plane substantially parallel to the plane of the cover plate by means of a pivot pin 30 attached to the cover plate which engages an opening in the tang portion 32 of the knife blade 26.

Knife blade locking means 28 comprises a locking arm 34 pivotally attached by means of a pivot pin 36 to the inside face of the cover plate. One end of arm 34 is provided with a detent 38 which is urged into engagement with the peripheral edge of the tang of the blade by a compression spring 41 which is attached to a finger-like element 42 on the cover plate and exerts a biasing force against the opposite end 43 of the locking arm from the detent. The peripheral edge of the tang includes a first shoulder means, or recess, 44, for receiving the detent of the locking arm when the blade is pivoted into position for use (FIG. 4) to lock the blade in its use position.

As best seen in FIG. 3, blade 26 is also provided with a second shoulder portion 46 which is engaged by the detent 38 when the blade is pivoted in closed position to prevent contact of the sharp edges of the blade with the locking arm 34. Thus, when the cover plate is removed from the base member, the knife blade may be readily pivoted by hand from its closed position (FIG. 3) to its extended position for use (FIG. 4), where it is locked into position by engagement of the detent 38 with tang recess 44. To return the blade to a closed position after use, the end 43 of the locking arm is depressed to unlock the blade and permit its pivotal movement back to closed position as shown in FIG. 3.

Figure 1:
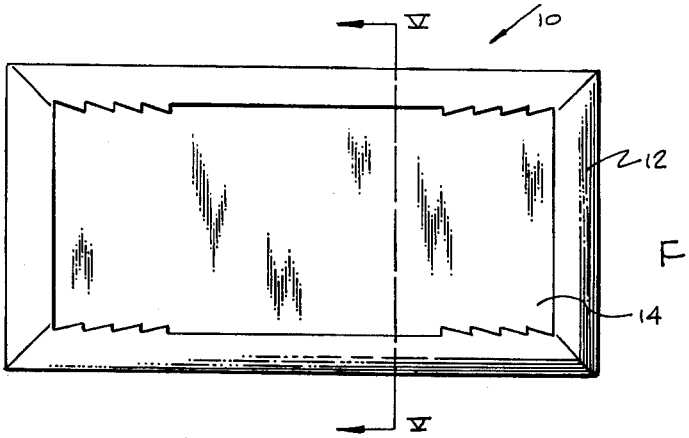
FIG. 1 is a front view of the combination belt buckle and knife of the present invention.
Figure 6:
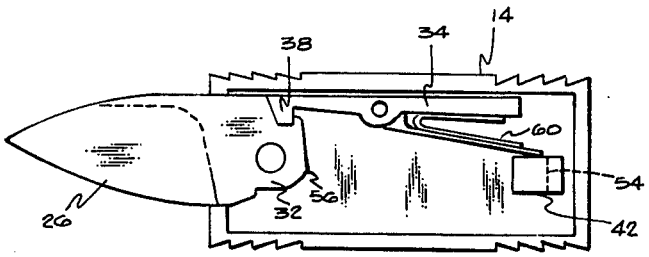
FIG. 6 is a view of the inside face of a cover plate for the base member of FIG. 2 illustrating a modified form of locking means for the knife blade when in use.

The means for removably attaching the cover plate 14 to the base member 16 are best shown in FIGS. 2 and 3. Base member 12 is provided with a resiliently deformable elongate element, such as a small metal rod 50 which is attached at its opposite ends to edge portions 22 of the base member to span one end portion of the recess 24 in spaced relation from the rear face 16 of the base member. Edge portion **22*a* of base member 12 at the opposite end of the recess from the rod 50 is provided with an undercut groove 52 for the reception of a portion of the peripheral edge of the tang 32 of the blade when the blade is in closed position, as seen in FIG. 3. As seen in FIGS. 3, 4 and 6, element 42 on the inside face of the cover plate is provided with an undercut groove or slot 54 for the reception and engagement of a central portion of rod 50 on the base member when the cover plate is attached to the base plate as shown in FIG. 1**.

The attachment and removal of the cover plate from the base member of the belt buckle may best be described by reference to FIGS. 2 and 3. To attach the cover plate to the base member, the right hand end of the cover plate, as seen in FIG. 3, with the blade in closed position as shown, is superposed over the left hand portion of the base member as seen in FIG. 2. Cover plate 14 is then slid along the base member to the left to engage the rod 50 in the recessed slot or groove 54 of element 42 on the inner face of the plate. The cover plate is then pushed slightly further to the left to slightly bend the rod 50 as the left hand end of the cover plate, as seen in FIG. 3, is pushed downwardly toward the recess 24 to snap the outer peripheral edge 56 of the tang 32 of the blade into the groove 52 on the right hand end of the base member, thus securing the plate to the base member with the knife blade and locking mechanism concealed in the recess 24 of the base member, as seen in FIG. 5. To remove the cover plate from the base member, the plate is pushed by the palm of the hand in a leftward direction, as seen in FIG. 1, to slightly bend the resilient rod 50 and remove the end of the tang of the blade from the base plate groove 52, whereby the end of the plate may be pivoted outwardly to detach the plate from the base member.

As seen in the embodiment of the invention illustrated in FIG. 6, the compression spring 41 of the locking means for the blade may be replaced by a conventional leaf spring 60 positioned between the end of the locking arm and the element 42 to biasingly urge the locking arm detent 38 into engagement with the peripheral edge of the tang of the blade.

As illustrated in the drawings, portions of the peripheral edge of the cover plate 14 may be provided with serrations 62 which not only provide an attractive decoration for the belt buckle, but also facilitates retention of the plate 14 by the hand when the plate serves as the handle for the knife during use.

Although the belt buckle knife of the present invention has been shown to be of a generally overall rectangular configuration, it should be understood that the exact shape, size, and decorative design of the belt buckle knife may vary, depending upon the aesthetic appearance desired. From the foregoing, it can be seen that the belt buckle knife of the present invention effectively serves as a decorative article of wear while providing for the concealed containment of a knife therein.

That which is claimed is:

1. A combination belt buckle and knife comprising a base member having a recess therein, means on said base member for attaching opposite ends of a belt thereto, a cover plate for said base member recess, means for removably attaching said cover plate to said base member in overlying relation with said recess, a knife blade, and means mounting said knife blade on the inside face of said cover plate for movement between a first position overlying the inside face of said cover plate whereby said knife blade is receivably concealed within said recess of said base member when said cover plate is attached to said base member, and a second position extending outwardly from said cover plate whereby said cover plate upon removal from said base plate serves as a handle for said knife blade.

2. A device as defined in claim 1 including means on said inside face of said cover plate for releasably locking said knife blade in said second position.

3. A device as defined in claim 1 wherein said knife blade includes a tang portion, and wherein said mounting means for said knife blade includes means mounted on the inside face of said cover plate and operatively connected to said tang portion of the knife blade for pivotal movement of said knife blade from said first position to said second position.

4. A device as defined in claim 3 wherein said tang portion of the knife blade includes an opening, and wherein said means mounted on said inside face of said cover plate comprises a pivot pin extending outwardly from said face and received in said tang opening to permit pivotal movement of said blade between said first and second positions in a plane substantially parallel to the plane of said cover plate.

5. A device as defined in claim 4 further including shoulder means on the peripheral edge of said tang portion, a locking arm movably mounted on said inside face of said cover plate, said locking arm having a detent removably engageable with said shoulder means on said tang portion when said blade is in said second position to prevent pivotal movement of said blade about said pivot pin.

6. A device as defined in claim 5 including means biasingly urging said locking arm detent into engagement with the periphery of said tang portion during pivotal movement of said blade, such that said detent is maintained in engagement with said shoulder means when said blade is in said second position.

7. A device as defined in claim 6 wherein said biasing means comprises compression spring means attached to said cover plate and engaging an opposite end of said locking arm from said detent to urge said detent into engagement with the periphery of said tang portion.

8. A device as defined in claim 6 wherein said biasing means comprises leaf spring means operatively attached to said cover plate and engaging said locking arm to urge said detent into engagement with the periphery of the tang portion of the blade.

9. A device as defined in claim 5 wherein said detent is on an end portion of said locking arm, and including pivot means connecting a mid portion of said locking arm to said plate for pivotal movement, and spring means operatively mounted on said plate and engaging the opposite end portion of said locking arm from said detent for biasingly urging said detent into engagement with the peripheral edge of said tang portion during movement of said blade between said first and second positions.

10. A device as defined in claim 5 including second shoulder means on a peripheral edge portion of said blade for engagement with said detent to prevent pivotal movement of the blade beyond said first position in a direction away from said second position.

11. A device as defined in claim 1 wherein said base member includes means defining peripheral walls of said recess, and wherein said means for removably attaching said cover plate to said base member comprises resiliently deformable rod means attached to said base member and spanning said recess adjacent one side portion thereof, an undercut groove in an opposite wall portion of said recess from said rod means, finger-like means on the inside face of said cover plate for engaging said rod means in partially surrounding relation thereto, with a portion of said tang portion of said blade residing within said undercut groove to retain said cover plate on said base member.

12. A device as defined in claim 1 wherein said cover plate has serrated peripheral edge portions to facilitate retention of said cover plate in the hand when said blade is in said second position for use.

* * * * *